US005221350A

United States Patent [19]

Tallier et al.

[11] Patent Number: 5,221,350

[45] Date of Patent: Jun. 22, 1993

[54] GUMMING DEVICE FOR A STRIP OF PAPER

[75] Inventors: Bernard Tallier, Gorgier; David Vuilleumier, Neuchâtel, both of Switzerland

[73] Assignee: Fabriques de Tabac Reunies, S.A., Neuchatel, Switzerland

[21] Appl. No.: 832,957

[22] Filed: Feb. 10, 1992

[30] Foreign Application Priority Data

Feb. 25, 1991 [CH] Switzerland ..... 553/91

[51] Int. Cl.[5] ..... B05C 1/12

[52] U.S. Cl. ..... 118/694; 118/684; 118/600; 118/259; 118/262; 118/DIG. 15; 118/688; 101/DIG. 45

[58] Field of Search ..... 118/681, 684, 686, 688, 118/690, 694, 696, 600, 211, 246, 259, 262, DIG. 15; 101/DIG. 45

[56] References Cited

U.S. PATENT DOCUMENTS

| | | | |
|---|---|---|---|
| 1,837,702 | 12/1931 | Canfield | 118/600 |
| 2,121,045 | 6/1938 | Paynter | 118/688 |
| 2,460,866 | 2/1949 | Wobbe et al. | 118/262 |
| 2,556,262 | 6/1951 | Faeber | 118/600 |
| 3,106,480 | 10/1963 | Baker | 118/211 |
| 3,647,525 | 3/1972 | Dahlgren | 118/246 |
| 3,669,061 | 6/1972 | Zuideveld | 118/262 |
| 3,995,585 | 12/1976 | Schuurmans | 118/262 |
| 4,325,321 | 4/1982 | Wahnschaff | 118/DIG. 15 |
| 4,407,867 | 10/1983 | Bruck et al. | 118/681 |
| 4,446,791 | 5/1984 | Stevens et al. | 118/694 |
| 4,446,814 | 5/1984 | Abendroth et al. | 118/694 |
| 4,792,078 | 12/1988 | Takahashi | 118/688 |

FOREIGN PATENT DOCUMENTS

| | | |
|---|---|---|
| 2471342 | 6/1981 | France . |
| WO9011518 | 10/1990 | PCT Int'l Appl. . |
| 993563 | 5/1965 | United Kingdom . |

*Primary Examiner*—W. Gary Jones
*Assistant Examiner*—Todd J. Burns
*Attorney, Agent, or Firm*—Jeffrey H. Ingerman

[57] ABSTRACT

A roll (30) of adhesive worked between two rollers (10, 12) of the gumming device is supplied by feed nozzles (34*a*, 34*b*) projecting fine streams of adhesive (35*a*, 35*b*) with monitored flow. In case of an increase in the measured viscosity of the adhesive or stopping of the machine on which the gumming device is used, a water-atomizing device (40) allows the viscosity to be reduced and prevents the adhesive from drying out. A dimension of the adhesive roll is monitored and controls regulation of the output of the adhesive-feeding nozzles. The gumming device thereby ensures proper gumming of a strip of paper (2).

10 Claims, 1 Drawing Sheet

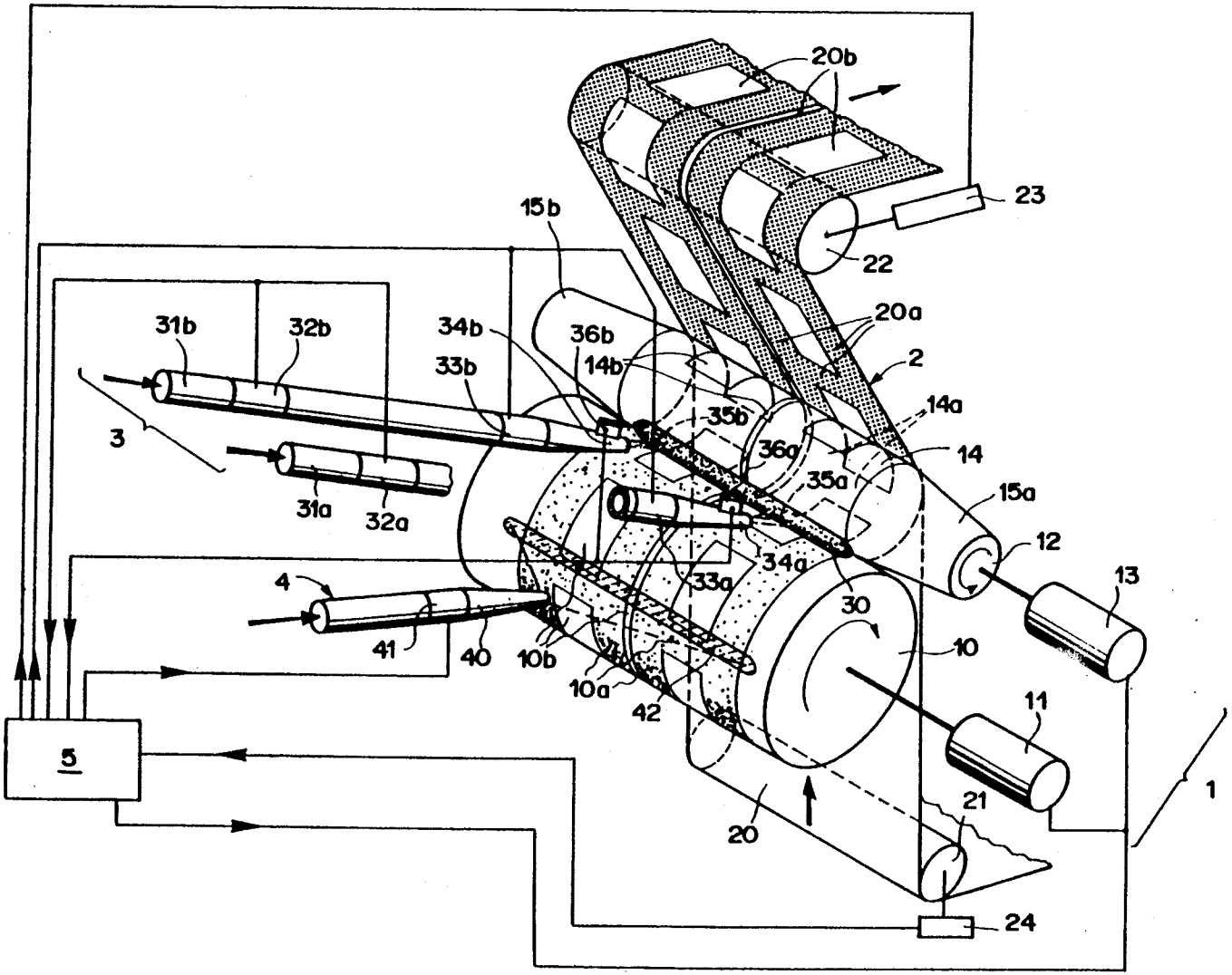
1
13
12
11
24
23
15a
14
10
21
14a
2
22
20a
20b
30
35a
36a
34a
33a
35b
20
42
14b
36b
10a
15b
10b
34b
33b
40
32a
41
32b
31a
4
31b
3
5

GUMMING DEVICE FOR A STRIP OF PAPER

This invention relates to adhesive-applying apparatus, and more particularly to a device for gumming a strip of paper, of the type having a first rotating gumming roller and a second oppositely rotating gumming roller in contact with one another along a generatrix, the axes of rotation of the two gumming rollers being parallel to one another, the strip of paper moving perpendicular to these axes of rotation while being pressed against the second of these rollers, a roll of adhesive being situated on a longitudinal portion of each of the rollers. The inventive gumming device is designed especially for use with a web of paper intended to cover the filters of cigarettes.

Such devices have already been proposed in the art. They generally consist of a plurality of rotating rollers, usually two, the first of which dips into a vat of semiliquid adhesive, causing it to form a roll, i.e., an elongated, roughly cylindrical portion of adhesive, just before the location where the two rollers are in contact along one of their generatrices, the adhesive necessary for gumming a strip of paper which advances while being contactingly pressed against the second roller being drawn from the aforementioned roll of adhesive by the second roller and applied to the strip of paper.

Ordinarily, it is not necessary or not desired for the entire surface of the strip of paper passing over the second roller to be gummed. In that case, the first roller comprises a plurality of zones, those corresponding to the surfaces of the strip of paper not to be gummed being absolutely smooth and/or covered with a coating preventing the adhesive from sticking thereto, whereas the zones corresponding to the surfaces to be gummed have a type of surface to which the adhesive can stick; the adhesive is then drawn from the roll and transferred to the second roller so as to be conveyed by the latter onto the respective surfaces of the strip of paper which are to be gummed. A significant and constant pressure must be maintained between the two rollers so that the adhesive may be properly transferred from the gumming zones of the first roller onto the outside surface of the second roller.

The main drawback of such a prior art device resides in the fact that the quality and quantity of adhesive supplying the roll are not checked, which may bring about poor quality of the gumming of the strip of paper; for the first roller continuously supplies adhesive to the roll, while the second roller draws only part of the adhesive contained in the roll for application to the strip of paper. As a result, the excess adhesive escapes at the ends of the lower roller and drops back into the vat.

The same thing happens when the advance of the strip of paper is interrupted for any reason while the rollers go on rotating in order to continue stirring the adhesive in the vat and to keep the existing roll of adhesive from drying up, whereas the strip of paper is no longer taking up adhesive from the second roller. Thus, the quality of the adhesive in the vat is non-homogeneous, being made up of adhesive coming directly from the supply and of adhesive which has already passed through the roll. Moreover, since the roll continues to be worked when the machine has stopped, the adhesive contained in the roll deteriorates owing to lamination of the latter between the two rollers. Furthermore, since the surface of the vat is exposed to the air, the adhesive in the vat may have a tendency to dry out or else may take up impurities and debris coming from the rest of the machine. The conjunction of these various causes results in unsatisfactory gumming of the strip of paper.

It is an object of this invention to provide an improved gumming device which remedies the foregoing drawbacks.

To this end, in the device for gumming a strip of paper according to the present invention, of the type initially mentioned, the second gumming roller is formed of a first cylindrical central part and of two end parts, the diameter of which is less than that of the cylindrical central part, the length of the cylindrical central part of the second roller being less than the length of the first cylindrical gumming roller.

A preferred embodiment of the invention will now be described in detail with reference to the accompanying drawing, the sole figure of which is a diagrammatic perspective view of the inventive gumming device.

A roller system 1 is composed of a circular cylindrical first roller 10 rotatingly driven by means 11 in the direction indicated by an arrow, and of a circular second roller 12 rotatingly driven by means 13 in the direction indicated by another arrow. Second roller 12 includes a cylindrical central part 14 and two parts 15*a* and 15*b* situated at the ends of roller 12 and having diameters becoming decreasingly less than the diameter of central cylindrical part 14.

In the preferred embodiment of the invention illustrated here, parts 15*a* and 15*b* are frustoconical, tapering toward the ends, or they may be made up of two cylindrical bearing surfaces having a smaller diameter than that of central part 14. The length of cylindrical part 14 of second roller 12 is less than the length of first roller 10 and at least equal to the width of a strip of paper 2. Strip 2, one or more areas of the underside 20 of which are to be gummed, runs through this machine portion between two rollers 21 and 22.

The position of the axis of rotation, i.e., the spindle, of roller 21 is fixed, whereas the spindle of roller 22 is mounted on a slide (not shown) and can be moved along this slide by an actuating means 23, which may be a conventional cam device or piston device. By acting upon actuating means 23, it is possible to cause roller 22 to advance or retract so that underside 20 of strip of paper 2 may be in or out of contact, as shown in the drawing, with a portion of the outside surface of central part 14 of second gumming roller 12.

Driving means 11 and 13 for rollers 10 and 12 drive the latter at speeds such that the contact of one roller against the other takes place with no slipping, driving means 11 and 13 being regulated so that strip of paper 2 passes over roller 12 with no slipping. Driving means 11 and 13 preferably take the form of gearwheels driven by the overall drive means (not shown) of the machine itself. Thus, the speeds of rotation of the two rollers 10 and 12 are proportional to one another and to the speed of the machine, the ratio between the numbers of teeth of the gearwheels driving the rollers being such that the latter roll upon one another with no slipping. Auxiliary driving means are used when the speed of the machine drops below a certain limit, as will be seen below.

Adhesive supply means 3, intended to produce a roll of adhesive 30, include first of all a storage vat (not shown) feeding one or more distribution tubes, preferably two distribution tubes 31*a* and 31*b* as shown in the drawing.

In order to ensure a constant quality of the adhesive, it is checked during its passage through the aforementioned tubes, viz., the viscosity of the adhesive is measured or compared with a reference value by devices indicated as 32*a* and 32*b*. Flow-control valves 33*a* and 33*b* are disposed near distributing nozzles 34*a* and 34*b*, each of which projects a fine stream of adhesive 35*a* and 35*b* in order to supply roll of adhesive 30. One or more sets of proximity measuring cells, preferably infrared-beam photoelectric cells, are disposed at suitable locations, e.g., near adhesive nozzles 34*a* and 34*b*, as indicated by reference numerals 36*a* and 36*b*, in order to measure one of the characteristic dimensions of adhesive roll 30, e.g., its transverse dimension. In another embodiment, not illustrated, the cells may be placed near the ends of the adhesive roll in order to check its length.

Inasmuch as the adhesive generally used is soluble in water, an adjustment or reduction of its viscosity may be obtained by adding a specific quantity of water to adhesive roll 30. For this purpose, the gumming device is supplemented by a water-supply device 4, composed of one or more atomizer nozzles, one of which is indicated as 40. This atomizer nozzle is preceded by a control valve 41 and projects a thin but relatively long stream positioned parallel to the axis of rotation of roller 10, as shown by reference numeral 42, substantially radially to first roller 10, over a sectional portion of roller 10 situated slightly before that comprising adhesive roll 30. The gumming device is further supplemented by an electronic control circuit 5.

The operation of the gumming device will now be described in all its functions in relation to a cigarette machine. Proper working of the machine, viz., a movement of the strip of paper 2 to be gummed, is detected by a detector diagrammatically indicated as 24, which may be of any known type, e.g., a coding disk disposed on roller 21 driving the strip of paper. Detector 24 sends a signal indicating the unwinding of strip of paper 2, as well as its unwinding speed, to electronic control circuit 5. Based upon the speed signal coming from detector 24, and when the speed of unwinding of strip of paper 2 is sufficient, circuit 5 controls actuating means 23 to cause the advancing of roller 22 and to flatten underside 20 of strip of paper 2 against a portion of the surface of central part 14 of roller 12. At the same time, electronic circuit 5 controls the setting in motion of the gear-wheels driving rolls 10 and 12 so that each of the latter is driven at a speed proportional to the speed at which strip of paper 2 is driven. Then circuit 5 controls the opening of control valves 33*a* and 33*b* so that streams of adhesive 35*a* and 35*b* can supply adhesive roll 30.

The adhesive necessary for gumming underside 20 of strip of paper 2 is drawn from roll 30 by second roller 12. The drawing shows a situation where it is not necessary for the whole of underside 20 to be gummed, but just a number of areas 20*a*, whereas the rest of the surface 20*b*, corresponding, for example, to the regions of the paper on which the aeration holes of the filter are disposed and to the locations where a blade cuts through for separating the cigarettes, is not gummed. To achieve this, the surface condition of portions 10*a* of the cylindrical surface of roller 10 is such that adhesive can stick to them and be drawn from adhesive roll 30 in order to be transferred to portions 14*a* of the central part 14 of roller 12, whereby areas 20*a* of strip of paper 2 can be gummed.

The surface condition of portions 10*b* of the cylindrical surface of roller 10, disposed between portions 10*a*, is such that the adhesive from roll 30 cannot stick to them, thus leaving portions 14*b* of central part 14 of roller 12, and consequently areas 20*b* of strip of paper 2, free of adhesive. To achieve this, surface portions 10*b* are extremely smooth and/or covered with a coating preventing the adhesive from sticking to them.

On the one hand, therefore, roll 30 is fed with adhesive by streams 35*a* and 35*b* from nozzles 34*a* and 34*b*, and on the other hand, adhesive is extracted from roll 30 by tracks 10*a* of first gumming roller 10 to be transferred to areas 20*a* of underside 20 of strip 2, via portions 14*a* of second gumming roller 12. Furthermore, adhesive roll 30 is continuously worked by rollers 10 and 12 so that the adhesive coming from nozzles 34*a* and 34*b* will be well spread over the entire length of cylindrical portion 14 of second roller 12 in order for surface portions 14*a* disposed at the ends of portion 14 to be properly supplied with adhesive. Nevertheless, in order to keep the adhesive from drying out, roll 30 must not be too great, nor should too large a quantity of adhesive be worked for too long a time before being drawn off by tracks 10*a* and 14*a*, respectively. For this purpose, the size of roll 30 is monitored, the quantity of adhesive supplied by nozzles 34*a* and 34*b* being adjusted so that roll 30 has just the necessary length, i.e., approximately the length of cylindrical portion 14, with any excess length being situated on frustoconical end portions 15*a* and 15*b* of roller 12, where it is recovered by any suitable wiping means (not shown).

Monitoring of the size of adhesive roll 30 takes place via measuring cells 36*a* and 36*b*, which measure the thickness of roll 30, or by cells (not shown) disposed close to the ends of roll 30 for measuring its length, these cells acting through a proximity effect and transmitting the control signals needed for electronic circuit 5 to act upon control valves 33*a* and 33*b* if the measured value does not correspond to a size reference value, in order to regulate the flow of adhesive to roll 30.

Inasmuch as, for one reason or another, the adhesive contained in adhesive supply means 3 may not be absolutely homogeneous, viscosity measuring devices 32*a* and 32*b* are installed in the feed lines and continuously monitor the viscosity of the adhesive flowing through these lines. If one of these viscosity measuring devices 32*a* or 32*b* measures an increase in viscosity, a signal is transmitted to electronic control circuit 5, which opens valve 41 of water-spraying device 4. Thus, a certain amount of water is added to adhesive roll 30 in order to preserve its low viscosity.

If detector 24 sensing the movement of strip of paper 2 should signal that the strip has stopped, or is advancing at an appreciably lower speed than normal, such stoppage of the machine or reduction in speed being attributable to any cause whatsoever, electronic circuit 5 acts first upon actuating means 23 to move driving roller 22 away and to separate strip of paper 2 from gumming roller 12, then upon means 11 and 13 driving rollers 10 and 12, respectively, to disengage these rollers from the overall drive of the machine and to start up an auxiliary drive (not shown), say, an electric motor, in order to keep these rollers rotating at a constant speed so that adhesive roll 30 continues to be worked. At the same time, circuit 5 stops the supply of adhesive to roll 30 by completely closing control valves 33*a* and 33*b* and opening valve 41 in order to spray roller 10, so that adhesive roll 30, which continues to be worked by rollers 10 and 12, will not dry out.

The arrows appearing at the inputs and outputs of control circuit 5 indicate the direction in which the signals are transmitted.

The inventive gumming device thus ensures good gumming of a strip of paper by checking both the quality and the quantity of adhesive forming the roll so that this adhesive does not deteriorate or dry up before being applied to the strip of paper. The gumming device is particularly suitable for gumming a strip of paper intended to wrap cigarette filters; it may equally well be adapted to any machine which is supposed to gum the surface of any sort of strip as it advances, whether such strip is of paper or any other material, e.g., of cloth or of plastic, and is intended for a completely different use than that described above.

What is claimed is:

1. In a device for gumming a strip of paper, of the type having a first cylindrical gumming roller a second gumming roller disposed in contact with said first gumming roller along a generatrix thereof, said first and second gumming rollers having axes of rotation parallel to one another, means for causing said first and second gumming rollers to rotate in opposite directions, means for causing the strip of paper to be pressed against said second gumming roller, and means for disposing an elongated portion of adhesive on a longitudinal section of each of said first and second gumming rollers, the improvement comprising:

said second gumming roller having a first cylindrical central part and two end parts, the diameter of each of said end parts being less than the diameter of said cylindrical central part, and the length of said cylindrical central part being less than the length of said first cylindrical gumming roller;

one or more distribution nozzles for supplying said elongated portion of adhesive;

one or more feed lines respectively connected to said one or more distribution nozzles, each of said feed lines comprising a respective viscosity monitoring device for monitoring the viscosity of the adhesive; and at least one water-spraying nozzle disposed radially with respect to said first gumming roller for spraying water onto said first gumming roller in response to readout from said viscosity monitoring devices, for lowering the viscosity of the adhesive.

2. The device of claim 1, wherein said two end parts of said second gumming roller are frustoconical and taper toward the ends thereof.

3. The device of claim 1, wherein said two end parts of said second gumming roller are cylindrical bearing surfaces.

4. The device of claim 1, wherein each of said nozzles comprises a flow-control valve for regulating the flow of adhesive to said rollers.

5. The device of claim 1, further comprising at least one photoelectric cell for measuring a transverse dimension of said elongated portion of adhesive.

6. The device of claim 5, further comprising electronic control means.

7. The device of claim 1 for use with a production machine, wherein:

each of said nozzles comprises a flow-control valve; said device further comprising:

electronic control means capable of controlling the separation of the strip of paper from said second gumming roller, the maintenance in rotation of said first and second gumming rollers, the partial or complete closing of said flow-control valves mounted on said nozzles, and the spraying of said first gumming roller, when the production machine operates at a speed less than a minimum limit or is stopped.

8. The device of claim 1, further comprising electronic control means capable of controlling the spraying of said first gumming roller when the measured viscosity exceeds a predetermined limit.

9. The device of claim 4, further comprising at least one photoelectric cell for measuring a transverse dimension of said elongated portion of adhesive, and electronic control means capable of controlling the partial or complete opening and closing of said flow-control valves mounted on said nozzles depending on whether the measured dimension of said elongated portion of adhesive is greater or less than a predetermined limit.

10. A device in accordance with any one of claim 1–3, 6 and 5–9 wherein said strip of paper is a strip of cigarette plug wrap paper, and said gumming rollers cause said paper to move perpendicular to said axes of rotation.

* * * * *